US012606274B1

(12) United States Patent
Krammer et al.

(10) Patent No.: US 12,606,274 B1
(45) Date of Patent: Apr. 21, 2026

(54) SWIM PLATFORM ASSEMBLIES FOR BOATS

(71) Applicant: Brunswick Corporation, Mettawa, IL (US)

(72) Inventors: Christopher D. Krammer, Deltona, FL (US); Keisha Bentley Spicer, Knoxville, TN (US)

(73) Assignee: Brunswick Corporation, Mettawa, IL (US)

( * ) Notice: Subject to any disclaimer, the term of this patent is extended or adjusted under 35 U.S.C. 154(b) by 706 days.

(21) Appl. No.: 17/963,782

(22) Filed: Oct. 11, 2022

(51) Int. Cl.
*B63B 17/00* (2006.01)

(52) U.S. Cl.
CPC ..... *B63B 17/00* (2013.01)

(58) Field of Classification Search
CPC .... B63B 2029/022; B63B 17/00; B63B 25/18
USPC ..... 114/343, 362, 364
See application file for complete search history.

(56) References Cited

U.S. PATENT DOCUMENTS

| | | | |
|---|---|---|---|
| 2,158,949 | A | 5/1939 | Sarles et al. |
| 2,174,622 | A | 10/1939 | Dale |
| 2,493,639 | A | 1/1950 | Pellegrini |
| 2,809,849 | A | 10/1957 | Benne |
| 2,825,582 | A | 3/1958 | Mcdonald |
| 3,195,680 | A | 7/1965 | Thornburg, Sr. et al. |
| 3,394,947 | A | 7/1968 | Strube, Sr. |
| 3,462,170 | A | 8/1969 | Smith et al. |
| 3,501,190 | A | 3/1970 | McCrea |
| 3,507,515 | A | 4/1970 | Brammer |
| 3,580,613 | A | 5/1971 | Northrop |
| 3,627,350 | A | 12/1971 | Cross |
| 3,716,254 | A | 2/1973 | Tarvin |
| 3,756,622 | A | 9/1973 | Pyle et al. |
| 3,774,720 | A | 11/1973 | Hovey |
| 3,799,288 | A | 3/1974 | Manuel et al. |
| 3,825,097 | A | 7/1974 | Owen |

(Continued)

FOREIGN PATENT DOCUMENTS

| | | |
|---|---|---|
| CN | 105599867 | 5/2016 |
| CN | 206615350 U | 11/2017 |

(Continued)

OTHER PUBLICATIONS

Swim Platform UTRA—Brand New Built-in Retractable Bench!, announced in YouTube on Mar. 12, 2018 [online], [site visited Apr. 13, 2023], available from the internet URL: https://www.youtube.com/watch?v=dRHH4rTha7U.

(Continued)

*Primary Examiner* — Daniel V Venne
(74) *Attorney, Agent, or Firm* — Andrus Intellectual Property Law, LLP

(57) ABSTRACT

A swim platform assembly is for a boat and comprises a deck which is pivotable relative to the boat into and between a raised position and a lowered position, wherein in the lowered position the deck extends transversely relative to a sidewall of the boat and provides a platform surface on which a swimmer can stand; and a suspension linkage configured to suspend the deck from the boat, the suspension linkage comprising a pivot bracket which defines an inner pivot axis about which the deck is pivotable into and between the raised and lowered positions.

25 Claims, 7 Drawing Sheets

(56) References Cited

U.S. PATENT DOCUMENTS 3,861,713 A 1/1975 Mckee
3,892,290 A 7/1975 Lang
3,927,903 A 12/1975 Jones
3,986,503 A 10/1976 Le Guillon
4,021,071 A 5/1977 Norman
4,174,115 A 11/1979 Youngblood
4,180,143 A 12/1979 Clugston
4,191,388 A 3/1980 Barksdale
4,194,754 A 3/1980 Hightower
4,198,070 A 4/1980 Weiler
4,275,664 A 6/1981 Reddy
4,293,967 A 10/1981 Ord
4,391,453 A 7/1983 Glaser
4,432,436 A 2/1984 Suiter
4,462,485 A 7/1984 Terry et al.
4,556,125 A 12/1985 Johnson
4,605,098 A 8/1986 Leuty
4,623,160 A 11/1986 Trudell
4,712,503 A 12/1987 Ritten
4,722,419 A 2/1988 Hoszowski
4,724,925 A 2/1988 Ritten
4,726,317 A 2/1988 Ritten et al.
4,733,752 A 3/1988 Sklar
4,742,795 A 5/1988 Deprey et al.
4,750,753 A 6/1988 Dezern
4,799,447 A 1/1989 Hebert et al.
4,819,987 A 4/1989 Stringer
4,823,910 A 4/1989 Day
4,846,487 A 7/1989 Criley
4,907,673 A 3/1990 Ginter et al.
4,926,965 A 5/1990 Fox
4,930,797 A 6/1990 Parrill
4,993,109 A 2/1991 Stevens
5,014,640 A 5/1991 Owen, Sr.
5,028,063 A 7/1991 Andrews
5,039,119 A 8/1991 Baughman
5,085,164 A 2/1992 Whitton
5,123,372 A 6/1992 Kobayashi et al.
5,152,244 A 10/1992 Jarmillo, Jr. et al.
5,222,456 A 6/1993 Friedrich
5,294,175 A 3/1994 Elton
5,435,260 A 7/1995 Granie et al.
5,458,080 A 10/1995 Jaramillo, Sr.
5,537,949 A 7/1996 Blevins et al.
5,549,312 A 8/1996 Garvert
5,560,679 A 10/1996 Barnholdt
5,572,944 A 11/1996 Slikkers et al.
5,584,733 A 12/1996 Kobayashi
5,632,224 A 5/1997 Schneider
5,647,632 A 7/1997 Fireman
5,732,996 A 3/1998 Graffy et al.
5,788,311 A 8/1998 Tibbals
5,803,475 A 9/1998 Dick
5,927,433 A 7/1999 Jaramillo, Sr.
5,970,905 A 10/1999 Jaramillo, Sr.
5,970,906 A 10/1999 Hrescak et al.
6,019,050 A 2/2000 Ranta
6,021,733 A 2/2000 Jaramillo, Sr.
6,058,875 A 5/2000 Krish, Jr.
6,082,751 A 7/2000 Hanes et al.
6,119,809 A 9/2000 McClendon, Jr.
6,145,865 A 11/2000 Cannara et al.
6,170,093 B1 1/2001 Kowalski
6,170,842 B1 1/2001 Mueller
6,182,598 B1 2/2001 Bozzo
6,213,486 B1 4/2001 Kunz et al.
D445,076 S 7/2001 Weinerman
6,270,106 B1 8/2001 Maki et al.
6,327,992 B1 12/2001 Martin
6,533,303 B1 3/2003 Watson
6,578,510 B1 6/2003 Scruggs et al.
6,588,839 B1 7/2003 Salzer
6,631,938 B1 10/2003 Burns
6,793,039 B2 9/2004 Schmid, Jr.
6,904,863 B2 6/2005 Mardikian et al.
6,905,158 B1 6/2005 Bastian
6,942,272 B2 9/2005 Livingston
6,966,597 B2 11/2005 Tegtmeier
7,055,838 B2 6/2006 Lambie
7,059,648 B2 6/2006 Livingston
7,121,226 B2 10/2006 Grimaldi
7,162,969 B2 1/2007 Houlder et al.
7,182,175 B1 2/2007 Schmitt et al.
7,237,503 B2 7/2007 Stepp
7,314,019 B1 1/2008 Curi et al.
7,341,016 B2 3/2008 Terleski et al.
7,377,563 B1 5/2008 Demick
7,401,833 B2 7/2008 Dryja
7,410,031 B2 8/2008 Jensen
7,416,238 B2 8/2008 Houston
7,434,825 B2 10/2008 Williams
7,475,652 B2 1/2009 Dvorak
7,503,276 B1 3/2009 Curi et al.
7,607,400 B2 10/2009 Scotti
7,735,894 B2 6/2010 King et al.
7,766,357 B2 8/2010 Arvanites
7,896,419 B2 3/2011 Elliott et al.
7,900,575 B2 3/2011 Walbridge et al.
7,946,243 B1 5/2011 Ulrich
8,056,496 B1 11/2011 Bussa
8,075,008 B1 12/2011 Hanser et al.
D653,174 S 1/2012 Parvey
8,297,215 B1 10/2012 Chinn
8,375,880 B1 * 2/2013 St. Clair, Jr. ..... B63B 29/00 182/84
8,434,420 B2 5/2013 Muller
8,444,225 B2 5/2013 Behe
8,479,677 B2 7/2013 Bolline et al.
8,522,922 B1 9/2013 Stokes
8,523,285 B2 9/2013 Wihinen
8,539,896 B2 9/2013 Bolline et al.
8,636,110 B2 1/2014 Ebbenga et al.
8,646,400 B2 2/2014 Grimaldi
8,671,869 B2 3/2014 Muller
D706,205 S 6/2014 Bradley
D710,288 S 8/2014 Dorton et al.
8,813,672 B2 8/2014 Nelson
D713,772 S 9/2014 Ziaylek et al.
8,833,290 B2 9/2014 Mueller
D717,713 S 11/2014 Whalen
8,899,169 B1 12/2014 Jaziri
8,905,354 B2 12/2014 Griffiths et al.
D726,635 S 4/2015 Curts
9,016,228 B2 4/2015 Dorton et al.
9,102,384 B2 8/2015 Pierce et al.
9,120,540 B1 9/2015 Foss et al.
D742,804 S 11/2015 Kim
9,205,896 B2 12/2015 Mueller
D748,561 S 2/2016 Canela
9,586,655 B1 * 3/2017 Butler ..... B63B 17/00
9,592,887 B2 3/2017 Frabetti
D806,625 S 1/2018 Hoffman et al.
9,937,979 B1 4/2018 Holmes
9,944,360 B2 4/2018 Franklin
10,017,235 B2 7/2018 Pappas et al.
10,086,913 B2 10/2018 Fafard
10,106,227 B2 10/2018 Allender
D833,358 S 11/2018 Lu
10,308,320 B1 6/2019 O'Neal
10,351,215 B2 7/2019 Scozzoli
10,399,645 B1 9/2019 Holmes
10,501,151 B2 12/2019 Allender
D877,302 S 3/2020 Hyde
10,703,446 B2 7/2020 Ricciardi et al.
D896,459 S 9/2020 Eilmus et al.
10,822,059 B2 11/2020 Miller
11,401,011 B2 8/2022 Johns
11,932,356 B1 3/2024 Ramsdell
12,357,097 B1 7/2025 Esham
2002/0003340 A1 1/2002 Hallquist
2002/0038623 A1 4/2002 Irish
2002/0070577 A1 6/2002 Pool et al.
2003/0070875 A1 4/2003 Medsker
2003/0178252 A1 9/2003 Schmid

(56) References Cited

U.S. PATENT DOCUMENTS

| | | | |
|---|---|---|---|
| 2004/0144296 | A1 | 7/2004 | Houlder |
| 2004/0160079 | A1 | 8/2004 | Harper et al. |
| 2004/0256833 | A1 | 12/2004 | Cervenka |
| 2005/0046219 | A1 | 3/2005 | Livingston |
| 2006/0137594 | A1 | 6/2006 | Stepp |
| 2008/0277958 | A1 | 11/2008 | King et al. |
| 2009/0078188 | A1 | 3/2009 | Thomas |
| 2010/0089697 | A1 | 4/2010 | Kreller |
| 2010/0170430 | A1 | 7/2010 | Gros |
| 2010/0288179 | A1 | 11/2010 | Grimaldi |
| 2011/0023770 | A1 | 2/2011 | Brown |
| 2012/0032418 | A1 | 2/2012 | Doucette et al. |
| 2012/0032490 | A1 | 2/2012 | Nowak et al. |
| 2013/0000542 | A1 | 1/2013 | Muller |
| 2013/0024074 | A1 | 1/2013 | Baur et al. |
| 2013/0025524 | A1 | 1/2013 | Cooney |
| 2013/0160695 | A1 | 6/2013 | Gratz |
| 2015/0217835 | A1 | 8/2015 | Gasper |
| 2019/0084655 | A1 | 3/2019 | Scozzoli |
| 2019/0233998 | A1 | 8/2019 | Maynes |
| 2020/0055572 | A1 | 2/2020 | Ricciardi et al. |
| 2020/0055573 | A1 | 2/2020 | Miller |
| 2021/0047005 | A1 | 2/2021 | Fafard |

FOREIGN PATENT DOCUMENTS

| | | | | |
|---|---|---|---|---|
| DE | 1077096 | | 3/1960 | |
| DE | 7401974 | U | 4/1974 | |
| DE | 202009007140 | | 9/2009 | |
| DE | 102008057537 | | 5/2010 | |
| DE | 102018133044 | | 6/2020 | |
| EP | 1216918 | | 6/2002 | |
| EP | 2065301 | | 6/2009 | |
| EP | 3578452 | | 12/2019 | |
| EP | 3290326 | | 1/2020 | |
| EP | 3771631 | | 2/2021 | |
| FR | 2235040 | | 1/1975 | |
| FR | 2601643 | A1 * | 1/1988 | ..... B63B 29/18 |
| FR | 2603236 | | 3/1988 | |
| FR | 2689085 | | 10/1993 | |
| GB | 254090 | | 7/1926 | |
| GB | 2476469 | | 6/2011 | |
| WO | 2007087736 | | 8/2007 | |
| WO | WO 2009077787 | | 6/2009 | |
| WO | 2011137548 | | 11/2011 | |
| WO | 2013036940 | | 3/2013 | |
| WO | 2014199314 | | 12/2014 | |
| WO | 2016089333 | | 6/2016 | |
| WO | 2017187369 | | 11/2017 | |

OTHER PUBLICATIONS

Cobalt Innovation—The Swim Stem, announced in YouTube on Nov. 10, 2010 [online], [site visited Apr. 13, 2023], Available from the internet URL: https://www.youtube.com/watch?v=VpmcKS_ytfg.

Motorized Swim Platform + Furry friends = Score!, announced in YouTube on Mar. 28, 2020 [online], [site visited Apr. 13, 2023], Available from the internet URL:https://www.youtube.com/watch?v=M96dosSTLFY.

Farrell, Unpublished U.S. Appl. No. 17/350,555, filed Jun. 17, 2021.

Diving Equipment Specialties: Dive Ladders; retrieved from http://www.techdivetools.com/boat/ladders.html on Mar. 13, 2023.

Four Winns Express Cruisers 2006, retrieved from https://web.archive.org/web/20140712184107/http://fourwinns.com/upload/Documents/Catalogs/2006/Four-Winns-Cruisers-Catalog.pdf on Mar. 13, 2023.

Four Winns Passion for Water: 2009 Sport Boats & Sport Cruisers; retrieved from https://web.archive.org/web/20140712174326/http://fourwinns.com/upload/Documents/Catalogs/2009/Four-Winns-Sport-Boats-Catalog.pdf on Mar. 13, 2023.

Intrepid 327CC; retrieved from https://www.intrepidpowerboats.com/boats/327-valor/ on Mar. 15, 2023.

Munson Bow Door Options, retrieved from 5. https://web.archive.org/web/20150224171602/http://munsonboats.com/bowdoors.php on Mar. 13, 2023.

Sheldon, U.S. Pat. No. 369,129; granted Aug. 30, 1887.

Office Action issued in U.S. Appl. No. 18/122,386, dated Jul. 18, 2025.

* cited by examiner

SWIM PLATFORM ASSEMBLIES FOR BOATS

FIELD

The present disclosure relates to swim platform assemblies for boats.

BACKGROUND

The following U.S. Patents and Patent Application are incorporated herein by reference.

U.S. Pat. No. 10,399,645 discloses a manual and submersible auxiliary swim platform for a vessel having a main aft platform, the main aft platform having a recessed area for receiving the auxiliary swim platform. A pair of bracket assemblies secure the auxiliary platform to the main aft platform, and both bracket assemblies have a first bracket member, a second bracket member, and a bushing. The bushing is interposed and secured to the first and second bracket members at a common end. The bracket members and bushing have limiter surfaces which limit rotational and pivotal movement of the bracket assemblies in conjunction with external edges, a pin and interface designs of the bracket assemblies.

U.S. Pat. No. 9,120,540 discloses a dive door for a marine vessel, the dive door having a planar body having an interior surface and an exterior surface. The door is disposed between the gunwale of the boat and is hingeably attached to the deck of the boat. The door is releasably retained to the gunwale by one or more latches disposed at a top edge of the dive door. One or more gas shocks are attached to the door and the boat so that the dive door is selectively operable between a deployed position and a closed position. When deployed, the interior surface of the dive door extends outwardly from the boat. In the closed position, the outer surface of the dive door matches the profile of the gunwale, providing a sleek integrated look. A ladder may be hinged to the dive door and is configured to extend downward into the water surface when the door is deployed.

U.S. Pat. No. 10,106,227 discloses a bulwark terrace with integrated door. The bulwark terrace is a portion of a bulwark on a ship or yacht which is hinged so as to be able to fold outwards and downwards and be flush with the deck after doing so, thereby extending the deck surface. The bulwark terrace also includes a door which may open independently of the bulwark terrace to allow boarding of the yacht or ship through the bulwark without deploying the bulwark terrace.

U.S. patent application Ser. No. 17/350,555 discloses a modular swim platform assembly for a boat. The assembly has a deck that is movable relative to the boat into and between a retracted position and an extended position, wherein the deck is located closer to the boat in the retracted position than the extended position. The deck has a base platform and a submersible platform, the submersible platform being movable out of the extended position while the base platform remains in the extended position, and particularly wherein the submersible platform is movable out of the extended position to a deployed position that is below the base platform.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In non-limiting examples disclosed herein, a swim platform assembly is for a boat and comprises a deck which is pivotable relative to the boat into and between a raised position and a lowered position, wherein in the lowered position the deck extends transversely relative to a sidewall of the boat and provides a platform surface on which a swimmer can stand; and a suspension linkage configured to suspend the deck from the boat, the suspension linkage comprising a pivot bracket which defines an inner pivot axis about which the deck is pivotable into and between the raised and lowered positions.

In non-limiting examples disclosed herein, a swim platform assembly for a boat may include a deck which is pivotable relative to the boat into and between a raised position and a lowered position, wherein in the lowered position the deck extends transversely relative to a sidewall of the boat and provides a platform surface on which a swimmer can stand; and a suspension linkage configured to support the deck from the boat such that the weight of the deck selectively biases the deck into the raised position or the lowered position, the suspension linkage comprising a pivot bracket which defines a first pivot axis about which the deck is pivotable into and between the raised and lowered positions.

Various other features, objects, and advantages of the invention will be made apparent from the following description taken together with the drawings.

BRIEF DESCRIPTION OF THE DRAWINGS

The present disclosure refers to the following drawing Figures.

DETAILED DESCRIPTION

During research and development in the field of marine vessels, the present inventor determined that marine vessels which include swim platforms can be more difficult to fit into confined spaces than comparable marine vessels without a swim platform. Existing swim platforms may be heavy and cumbersome, so the process of folding or removing a swim platform requires multiple people to lift the platform and remove all necessary pins or other connectors. As such, some users may forgo raising or removing the swim platform, which increases the risk of damaging the marine vessel or the swim platform. During research and development in the field of marine vessels, the present inventor determined it would be advantageous to provide a swim platform assembly that can be automatically moved into a retracted position for storing or docking the marine vessel. The present disclosure is a result of the present inventor's efforts in this regard.

Figure 1:
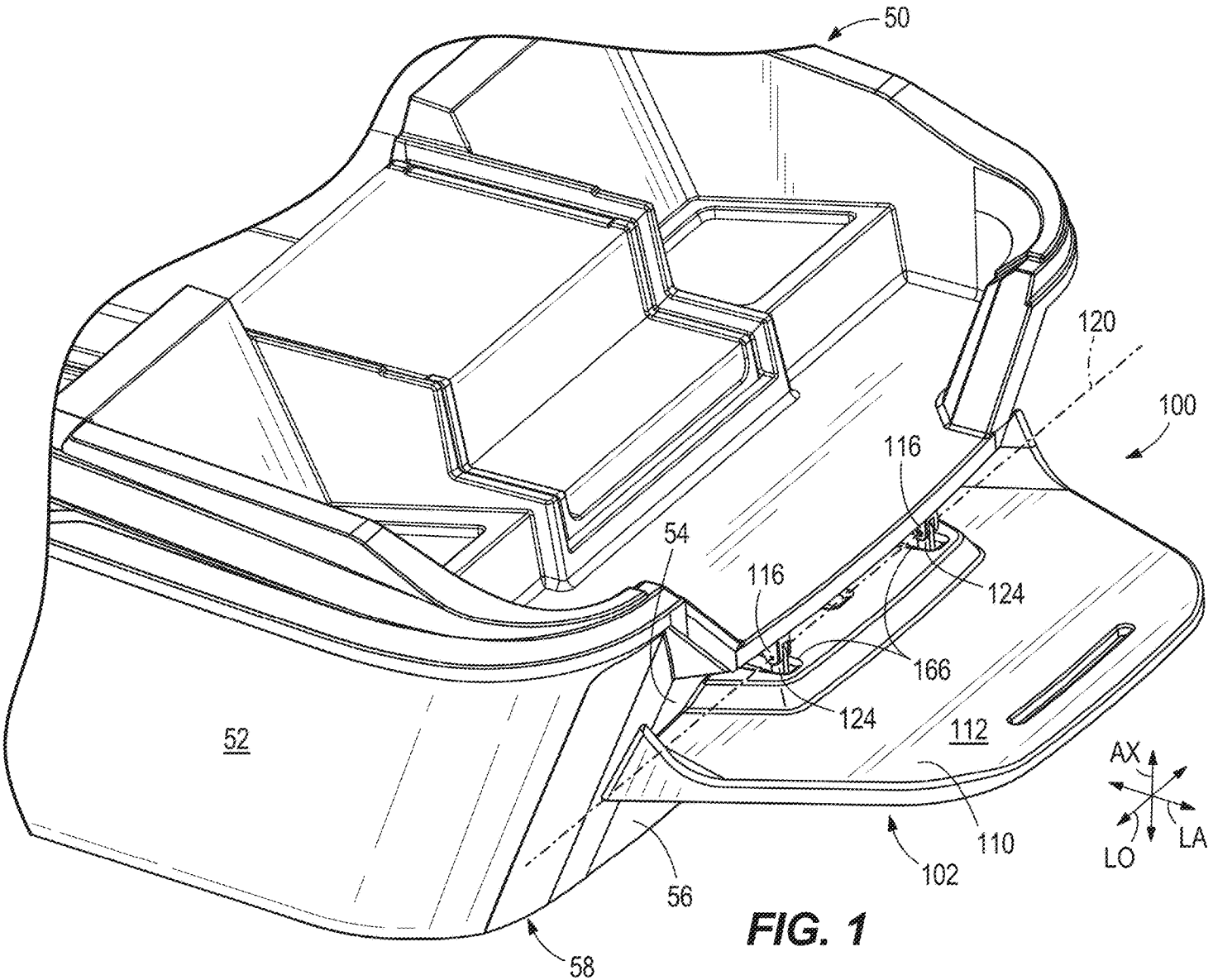
FIG. 1 is a top-rear perspective view of a boat with an embodiment of a novel swim platform assembly.
Figure 2:
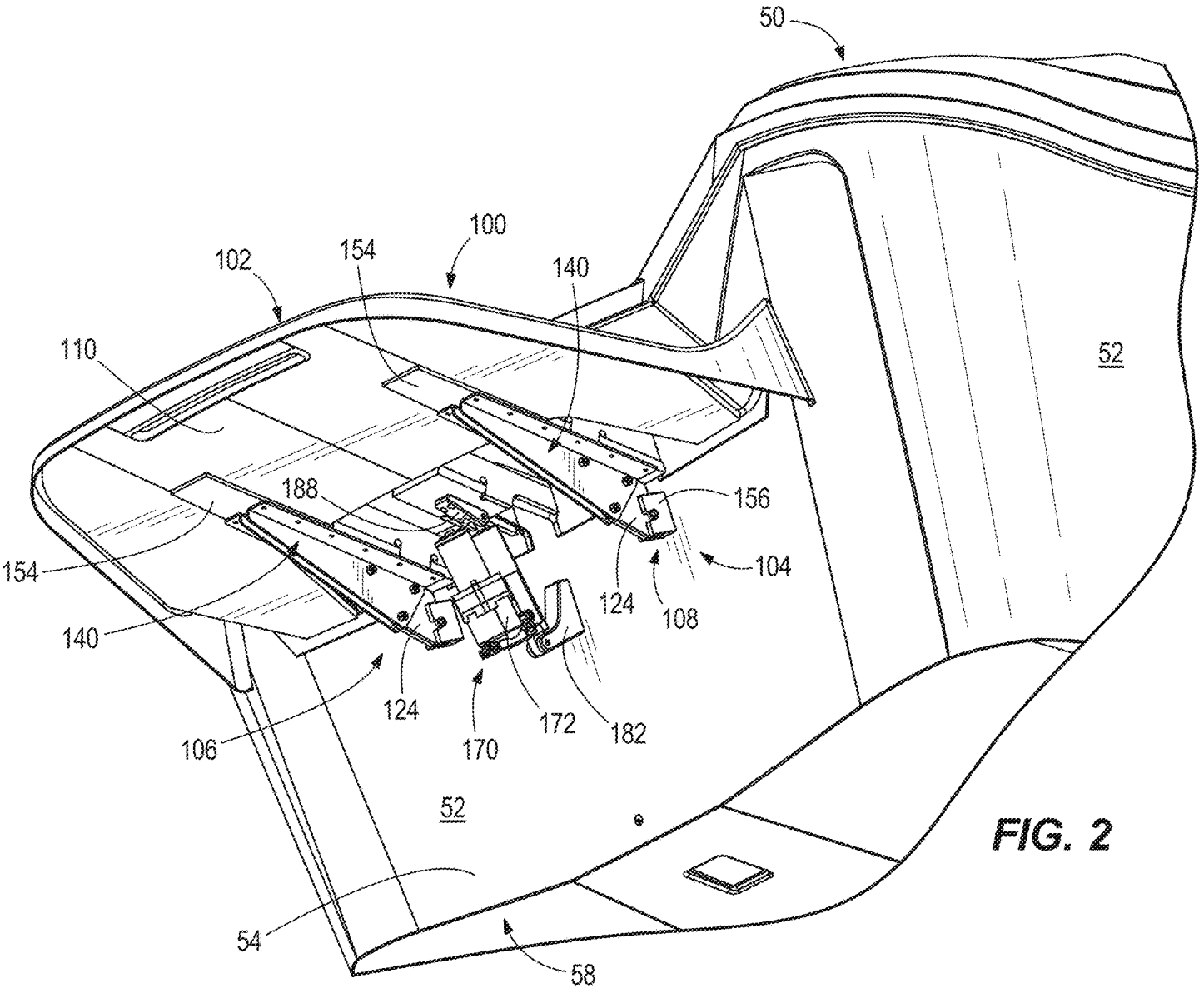
FIG. 2 is a bottom-rear perspective view of the boat and swim platform assembly of FIG. 1 with the swim platform assembly in a lowered position.
Figure 3:
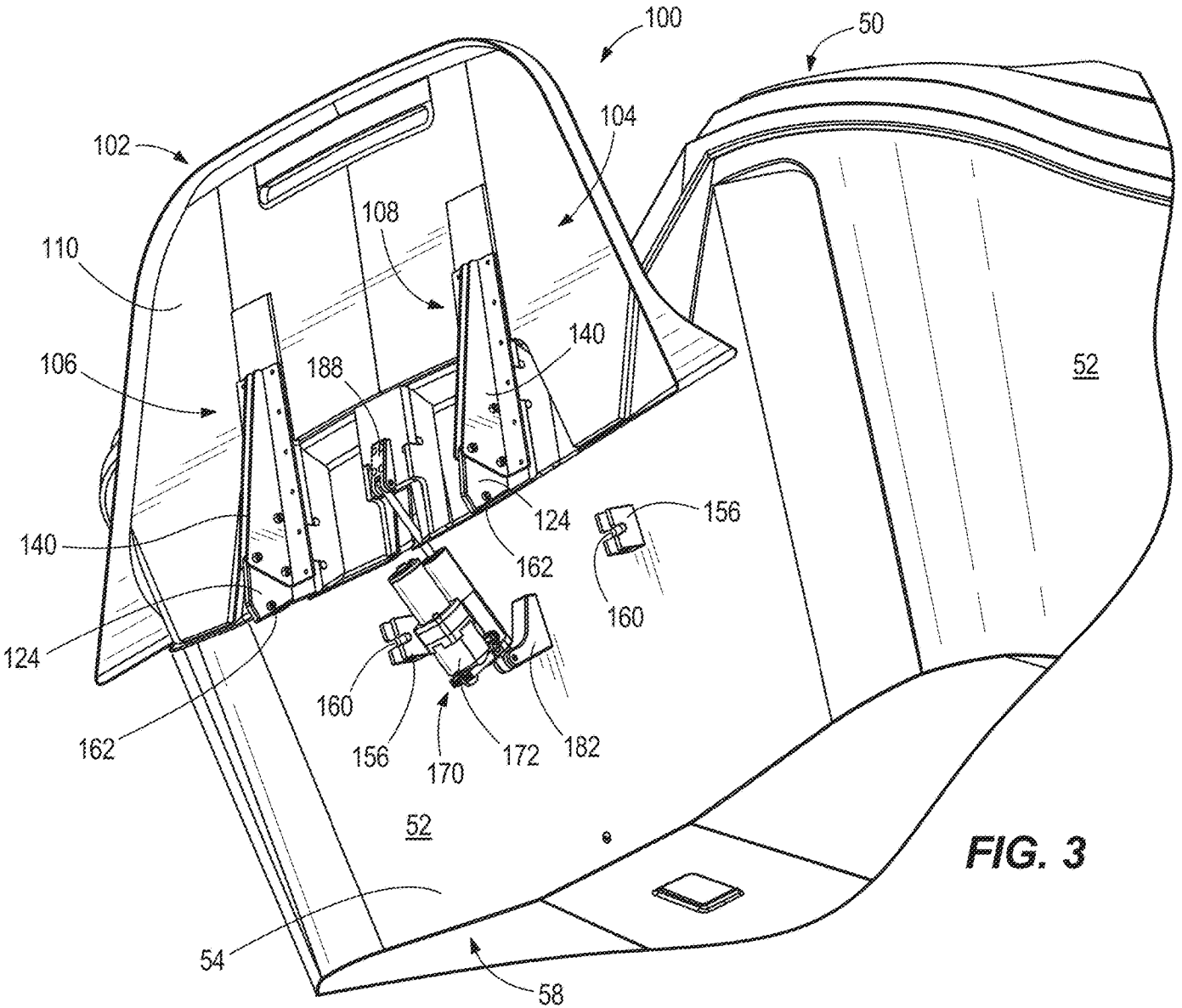
FIG. 3 is the perspective view of the boat and swim platform assembly of FIG. 2 with the swim platform assembly in a raised position.

FIGS. 1-3 illustrate a novel swim platform assembly 100 for a boat 50 according to the present disclosure. In the illustrated embodiment, the swim platform assembly 100 and boat 50 extend from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. The swim platform assembly 100 is shown mounted to a sidewall 54 of the hull 52 of a boat 50, in particular to the transom 56 at the stern 58 of the boat 50. However, this is merely exemplary, and it should be recognized that depending on the type of boat 50, the assembly 100 can be mounted to other surfaces of the boat 50, including for example the bow, the port side, or the starboard side of the boat 50. The type and configuration of the boat 50 is exemplary and can vary from what is shown.

The swim platform assembly 100 includes a deck 102 that is pivotable relative to the boat 50 into and between a raised position and a lowered position, and a suspension linkage 104 configured to suspend the deck 102 from the boat 50. FIGS. 1 and 2 illustrate the deck 102 in the lowered position in which the deck 102 extends transversely relative to the sidewall 54 of the boat 50 and FIG. 3 illustrates the deck 102 in a raised position. While in the lowered position, a platform 110 of the deck 102 provides a platform surface 112 on which a swimmer can stand.

Figure 4:
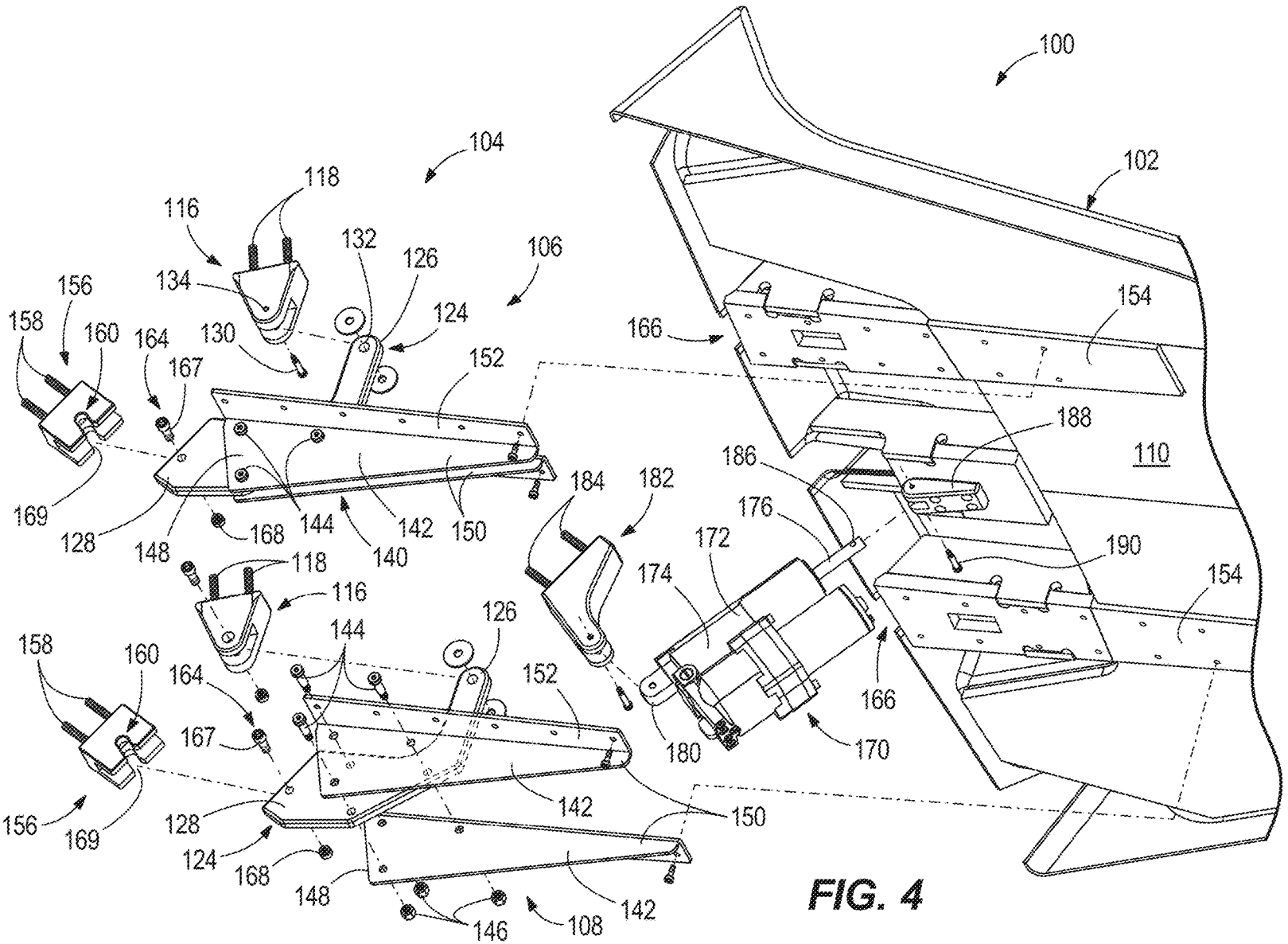
FIG. 4 is an exploded perspective view of the deck and suspension linkage of the swim platform assembly of FIG. 3.

Referring to FIG. 4, the suspension linkage 104 includes a port side suspension assembly 106 and a starboard side suspension assembly 108 that each support the deck 102. In the illustrated embodiments, the port side suspension assembly 106 and the starboard side suspension assembly 108 are substantially the same. Some embodiments, however, may include a port side suspension assembly and/or a starboard side suspension assembly that is different than those of the illustrated embodiments. Additionally or alternatively, a swim platform assembly 100 may be configured with only one suspension assembly. Further still, a swim platform assembly may be configured with at least one additional suspension assembly, which may be different or the same as those of the illustrated embodiments.

With continued reference to FIG. 4, the port and starboard suspension assemblies 106, 108 each include a pivot bracket 116 which is secured to the sidewall 54 of the boat 50 by fasteners 118. The port and starboard pivot brackets 116 are positioned in alignment with each other so that the pivot brackets 116 define a pivot axis 120 (see, e.g., FIG. 1) about which the deck 102 is pivotable into and between the raised and lowered positions. Each suspension assembly 106, 108 of the suspension linkage 104 includes a suspension arm 124 which couples the deck 102 to the pivot bracket 116 such that the deck 102 is suspended from the suspension arm 124 and pivot brackets 116.

The port and starboard suspension arms 124 are each coupled to a respective one of the port and starboard pivot brackets 116 along the pivot axis 120 and suspend the deck 102 from the pivot brackets 116. Each suspension arm 124 is generally L-shaped and includes a vertically extending first end portion 126 and a longitudinally extending second end portion 128. The first end portion 126 is coupled to the respective pivot bracket 116 along the pivot axis 120 by a pin or fastener 130, which extends through a through bore 132 in the first end portion 126 and corresponding bores 134 in the pivot bracket 116. As illustrated in FIGS. 1, 2, and 4, the first end portions 126 of the port and starboard suspension arms 124 extend through a slot 166 in the deck 102 such that, when the deck 102 is in the lowered position, the pivot axis 120 is located vertically above the deck 102.

The second end portions 128 of the suspension arms 124 are positioned below the deck 102 while the swim platform assembly 100 is in the lowered position and extend longitudinally towards the sidewall 54 of the boat 50. The second end portions 128 are coupled to the deck 102 and support the deck 102 from the pivot brackets 116. In the illustrated embodiments, the deck 102 includes a supporting frame 140 which couples the platform 110 to the port and starboard suspension arms 124. Each supporting frame 140 includes gusset plates 142 which are secured to opposite lateral sides of the second end portion 128 of the suspension arms 124 with bolts 144 and corresponding nuts 146. The gusset plates 142 each include an inner end portion 148 that faces the sidewall 54 of the boat 50 when the deck 102 is in the lowered position and an outer end portion 150 located opposite the inner end portion 148. Laterally projecting flanges 152 extends along the upper edges of the gusset plates 142 and are configured to couple the suspension arms 124 to corresponding mounting surfaces 154 on the bottom side of the platform 110. Some embodiments, however, may include at least one supporting frame 140 that is configured differently than those of the illustrated embodiments. For example, a supporting frame may include only one gusset plate coupled to each of the suspension arms, and/or a suspension arm may be configured to be coupled directly to the deck.

Referring to FIGS. 2-4, the swim platform assembly 100 includes port and starboard base brackets 156 which automatically mate with the suspension linkage 104 and/or the deck 102, thereby supporting the deck 102 when the deck 102 is moved into the lowered position. Each of the base brackets 156 is coupled to the sidewall 54 of the boat 50 with fasteners 158. A receiver 160 in each base bracket 156 is configured to automatically receives a member 162 of the suspension linkage when the deck 102 is moved into the lowered position. In the illustrated embodiments, the members 162 are configured as protrusions 164 on the suspension linkage 104. The receivers 160 are configured as a slots 169 in the base brackets 156 that are configured to receive the member 162. In particular, the illustrated members 162 are a bolt 167 and nut 168 which extend through the second end portion 128 of the suspension arms 124 and project laterally therefrom. Some embodiments, however, may include a base bracket and/or a member that are differently configured. For example, at least one of the members may be positioned on a different part of a suspension arm, and/or a member configured to be received in a base bracket may be positioned on the deck.

With continued reference to FIGS. 2-4, the swim platform assembly 100 includes an actuator 170 configured to automatically move the deck 102 into and between the raised position and the lowered position. In the illustrated example, actuator 170 is a hydraulically actuated linear actuator 172 having a cylinder 174 and a piston rod 176 that is extendible and retractable relative to the cylinder 174 under force of pressurized hydraulic fluid. A suitable example is commercially available from Parker Hannifin Corporation, part number 651057. The linear actuator 172 has a first end 180 pivotably coupled to the sidewall 54 by a mounting bracket 182 via a pin or fastener 183. The mounting bracket 182 is secured to the sidewall 54 with fasteners 184 and facilitates pivoting of the first end 180 relative to the boat 50. The linear actuator 172 also has a second end 186 that is pivotably coupled to the platform 110 via a platform bracket 188 by a pin or fastener 190. As will be further described herein below, extension of the linear actuator 172 pivots the swim platform assembly 100 into the extended position and retraction of the linear actuators 172 pivots the assembly 100 into the retracted position. The illustrated embodiments of a swim platform assembly. The type and configuration of actuator 170 can vary from that is shown, and in other examples could comprise any number of hydraulic and/electro-mechanical linear actuators, and/or the like.

Figure 5:
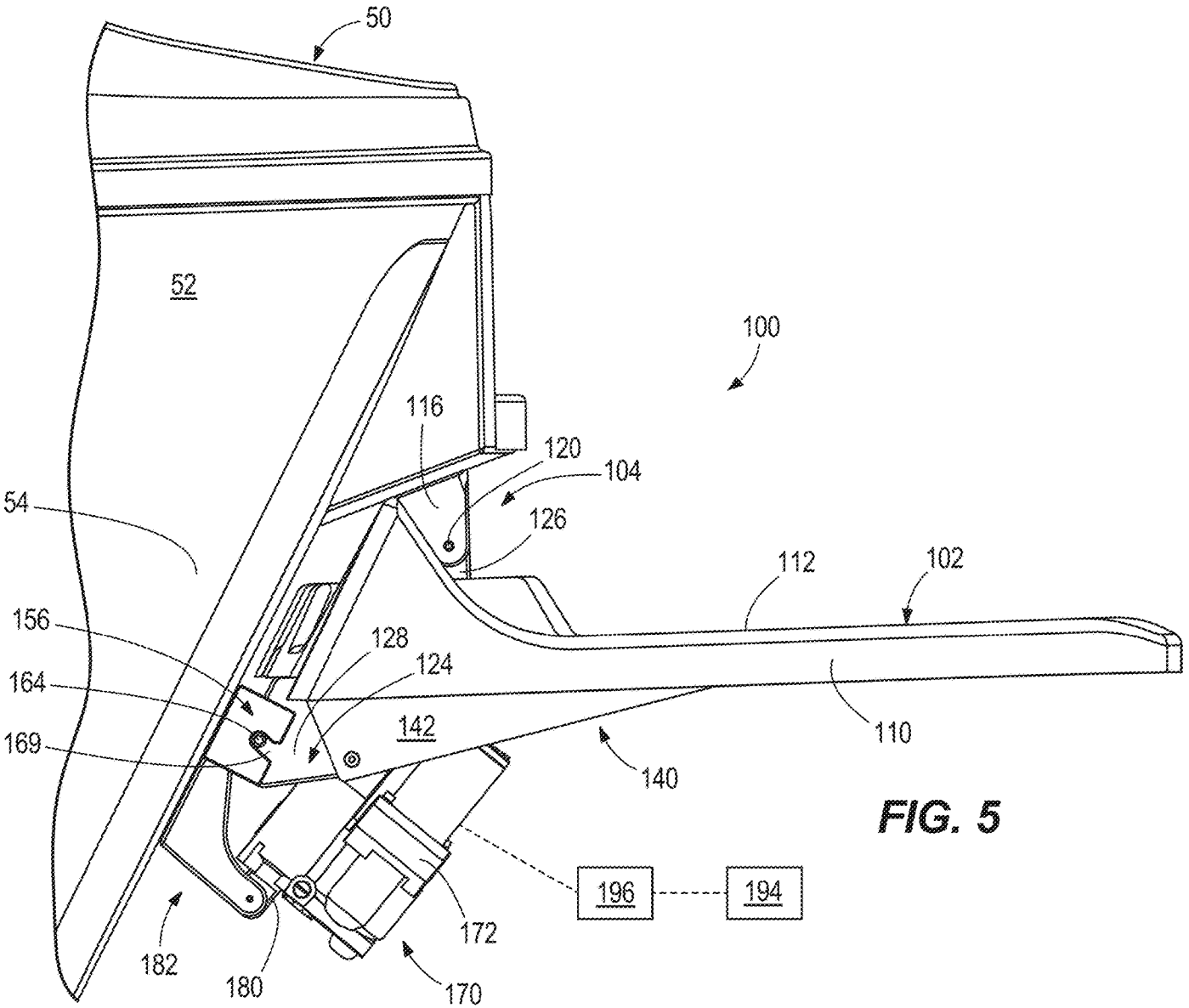
FIG. 5 is a side view of the boat and swim platform assembly of FIG. 3 with the swim platform assembly in the lowered position.
Figure 6:
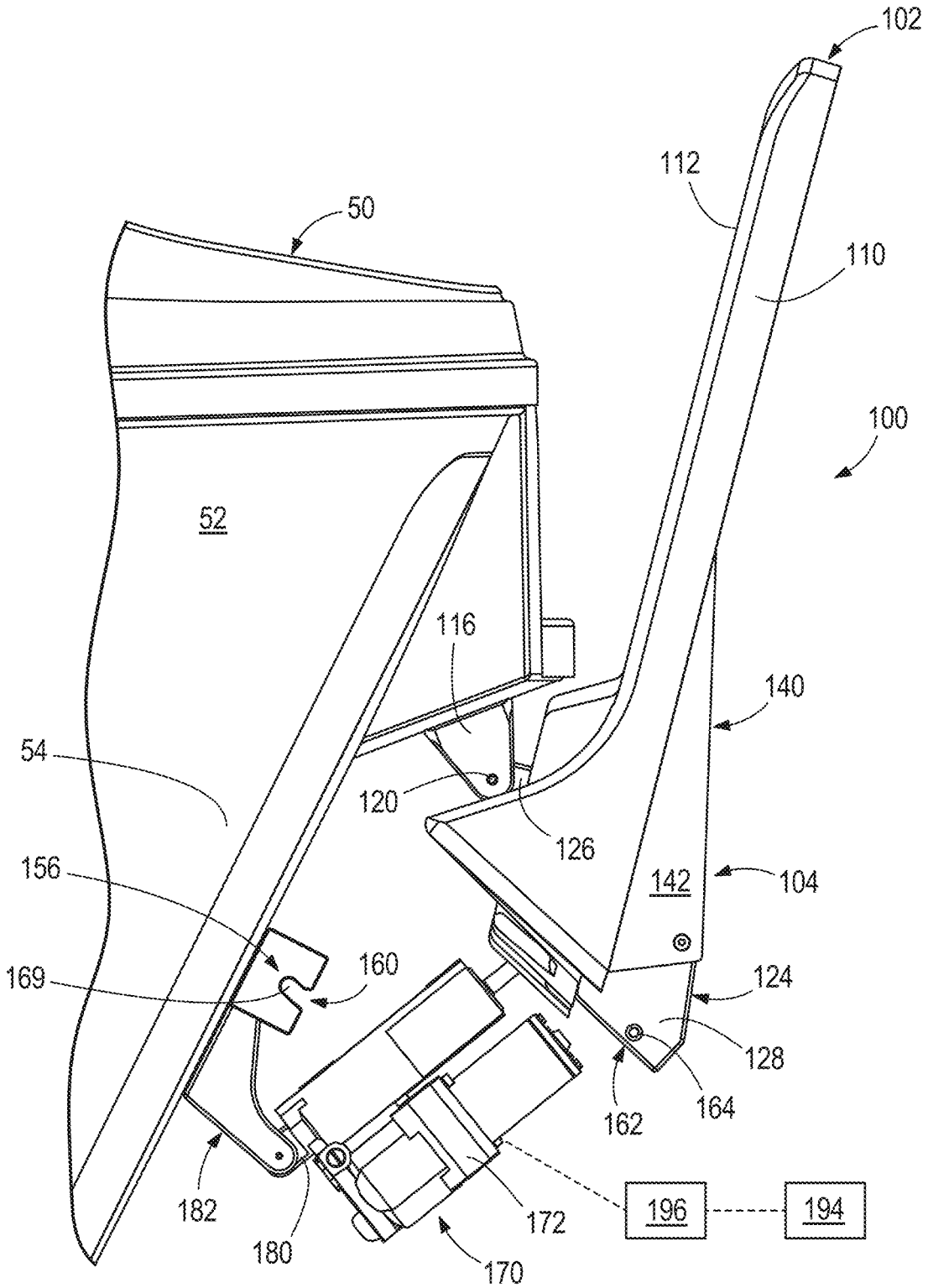
FIG. 6 the side view of the boat and swim platform assembly of FIG. 5 with the swim platform assembly in the raised position.

Referring to FIGS. 5-6, the swim platform assembly 100 may include an operator input device 194 configured to control a control system 196. The control system 196 is configured to selectively actuate the actuator 170 to move the swim platform assembly into and between the lowered position (FIG. 5) and the raised position (FIG. 6). The control system 196 can be any conventional device for controlling the actuator 170. In examples wherein the actuator 170 is hydraulically actuated, the control system 196 can include one or more conventional hydraulic pumps, valves and/or switching devices for controlling a flow of pressurized hydraulic fluid to the actuator 170. However as mentioned above, the actuator 170 does not necessarily have to be a hydraulic actuator, and for example can comprise an electro-mechanical device such as one or more electric motors, and/or the like. The type and configuration of operator input device 194 can be any conventional device for inputting a command to or otherwise controlling the control system 196, including for example a mechanical switch, manual lever, push button, joystick, and/or the like. In certain examples, the operator input device 194 can include a touch screen for inputting to a programmable controller for controlling the actuator 170. The operator input device 194 and the control system 196 may be positioned on the boat or at a remote location, such as a remote user device. Some embodiments, however, may omit at least one of the operator input device 194 and the control system. For example, an operator input device may be configured to directly control the actuation of the actuator 170.

Operation of the swim platform assembly 100 will now be described with reference to FIGS. 5 and 6. Referring to FIG. 5, when for example the boat 50 is at rest, the deck 102 is suspended from the port and starboard pivot brackets 116 via the suspension arms 124. The port and starboard base brackets 156 also support the deck 102 via engagement between the protrusions 164 and corresponding slots 169.

To move the deck 102 from the lowed position to the raised position, the linear actuator 172 may be controlled to extend the piston rod 176 to raise the deck 102. As the linear actuator 172 extends, the second end portions 128 of the port and starboard suspension arms 124 are pushed away from the sidewall 54 of the boat 50 and the protrusions 164 thereon slide out of the slots 169 on the base brackets 156. Extending the linear actuator 172 pivots the swim platform assembly 100 into the raised position as the suspension arms 124 and the deck 102 to pivot about the pivot axis 120. When the swim platform assembly 100 is in the raised position, as illustrated in FIG. 6, the overall length of the boat 50 is reduced, which may be useful when docking the boat 50, when transporting the boat 50 on a trailer (not shown) or when the boat 50 is otherwise maneuvered through a configured environment.

To move the deck 102 back into the lowered position, the linear actuator 172 can be controlled to retract the piston rod 176. As the linear actuator 172 retracts the piston rod 176, the suspension arms 124 and the deck 102 pivot about the pivot axis 120 as the deck 102 returns to the lowered position. As the second end portions 128 of the port and starboard suspension arms 124 approach the sidewall 54 of the boat 50, the members 162 on the port and starboard suspension arms 124 are received in the receivers 160 of a corresponding one of the port and starboard base brackets 156.

Figure 7:
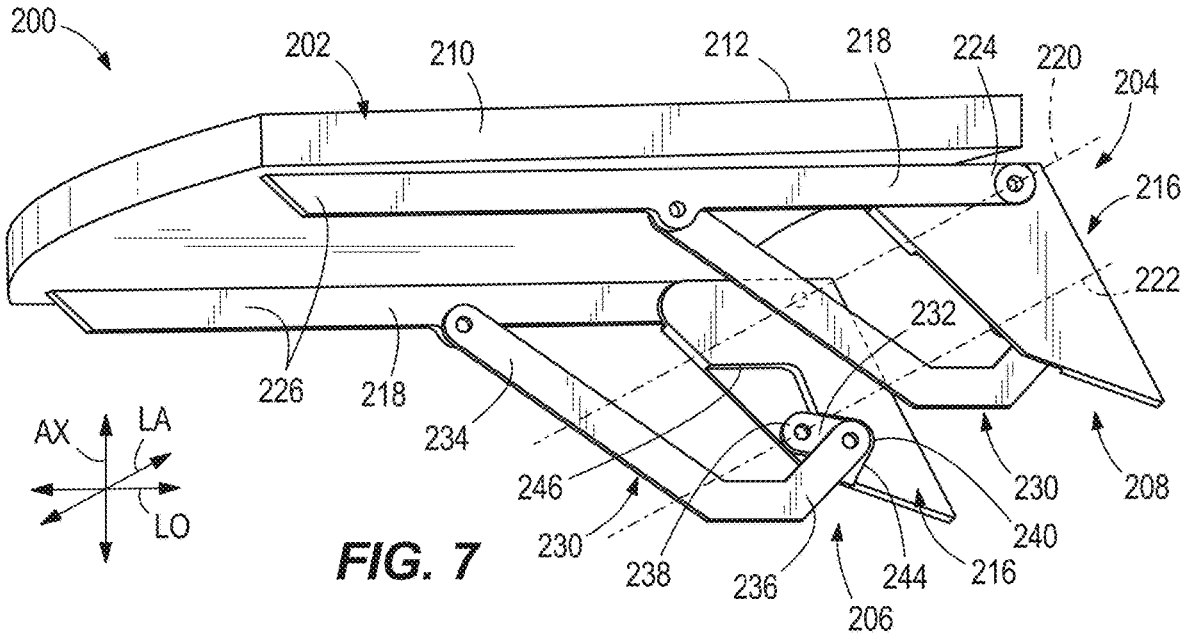
FIG. 7 is a perspective view of another embodiment of a novel swim platform assembly in the lowered position.
Figure 8:
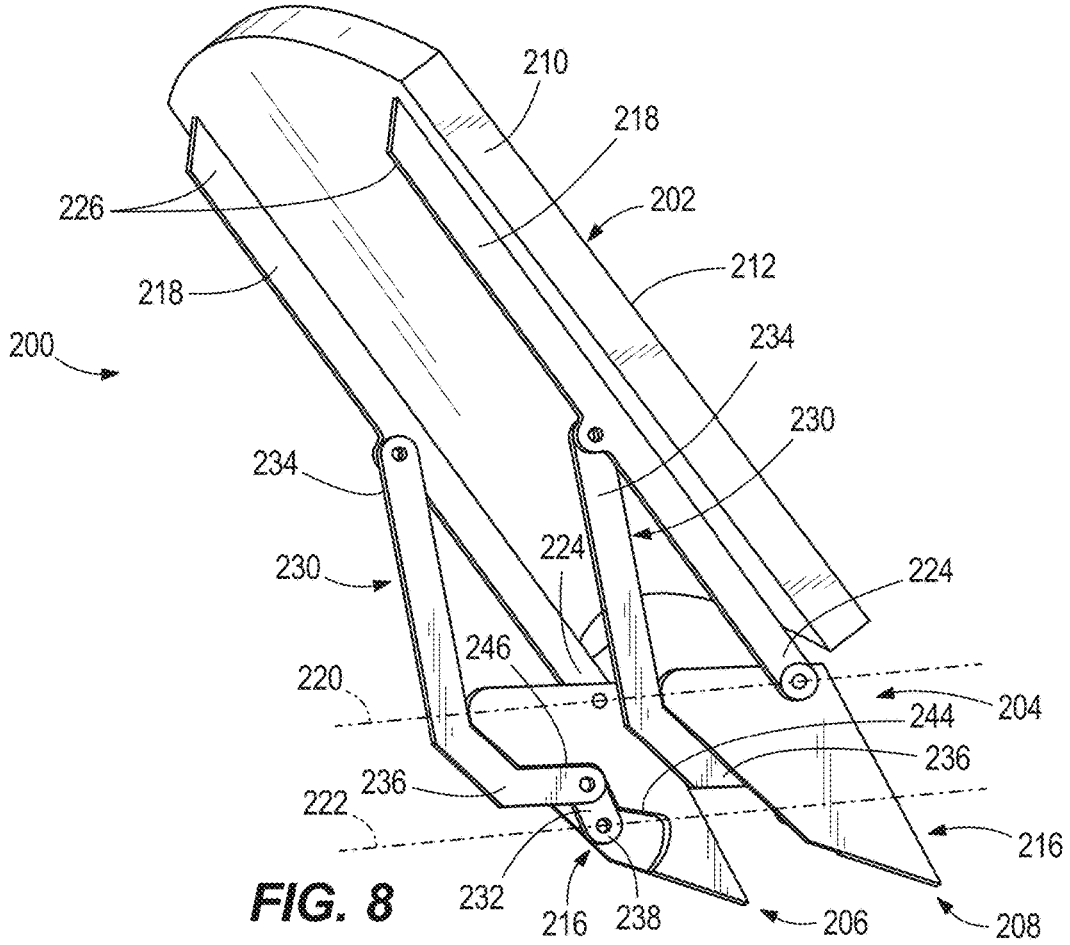
FIG. 8 is the perspective view of the swim platform assembly of FIG. 7 with the swim platform assembly in the raised position.

Some embodiments of a swim platform assembly may be configured differently than the assembly 100 of FIGS. 1-6. For example, FIGS. 7 and 8 illustrate an embodiment of a swim platform assembly 200 configured to be mounted to a sidewall of a boat (not shown). In the illustrated embodiment, the swim platform assembly 200 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO.

The swim platform assembly 200 includes a deck 202, which is pivotable relative to the boat into and between a raised position and a lowered position, and a suspension linkage 204 configured to support the deck 202 from the boat. FIG. 7 illustrates the deck 102 in the lowered position in which the deck 202 extends transversely relative to a sidewall of the boat to which it is attached, and FIG. 8 illustrates the deck 202 in a raised position. While in the lowered position, a platform 210 of the deck 202 provides a platform surface 212 on which a swimmer can stand.

The suspension linkage 204 includes a port side suspension assembly 206 and a starboard side suspension assembly 208 that each support the deck 202. In the illustrated embodiments, the port side suspension assembly 206 and the starboard side suspension assembly 208 are substantially the same. Some embodiments, however, may include a port side suspension assembly and/or a starboard side suspension assembly that is different than those of the illustrated embodiments. Additionally or alternatively, a swim platform assembly 200 may be configured with only one suspension assembly, and another swim platform assembly may be configured with at least one additional suspension assembly, which may be different or the same as those of the illustrated embodiments.

With continued reference to FIGS. 7 and 8, the port and starboard suspension assemblies 206, 208 each include a pivot bracket 216 configured to be secured to the sidewall of the boat. The port and starboard pivot brackets 216 are positioned in alignment with each other so that the pivot brackets 216 define a first pivot axis 220 about which the deck 202 is pivotable into and between the raised and lowered positions. The deck 202 includes port and starboard pivot supports 218 which each extend longitudinally along and the bottom of the deck 202 from a first end 124 coupled to a respective one of the port and starboard pivot brackets 216 to an opposite second end 226. Pivoting the deck 202 into and between the raised position and the lowered position pivots the pivot support 218 and the deck 212 about the first pivot axis 220.

Each suspension assembly 206, 208 of the suspension linkage 204 includes a first arm 230 and a second arm 232 rotatably coupled to the first arm 230. The first arm 230 has a first end portion 234 that is rotatably coupled the deck 202 and a second end portion 236 that is rotatably coupled to the second arm 232. In the illustrated embodiments the first end portion 234 of the port and starboard first arms 230 is coupled to a respective one of the port and starboard pivot supports 218. Some embodiments, however, may be differently configured. For example, at least one of the port and starboard first arms 230 may be rotatably coupled to the deck 202.

The second pivot arms 232 each include a first end 238 rotatably coupled to the second end portion 236 of the first arm 230 and a second end 240 that is rotatably coupled to a respective one of the pivot brackets 216 along a second pivot axis 222, which is positioned below the first pivot axis 220. As the deck 202 is pivoted into and between the raised position and the lowered position pivots, the second arm 232 rotates about the second pivot axis 220. The pivot brackets 216 each include a first stop 244 and a second stop 246. The first stop 244 and the second stop 246 are configured to be engaged by second arm 232 when the deck 202 is in the raised or lowered position, respectively. In the illustrated embodiments, the first and second stops 244, 246 are configured as cutouts formed into a lateral side of the port and starboard pivot brackets 216. Other embodiments, however, may include at least one stop that is differently configured. For example, at least one of the first stops and/or at least one of the second stops may be configured as a projection that extends laterally from a corresponding one of the pivot brackets.

The suspension linkage 204 of the novel swim platform assembly 200 is configured such that the weight of the deck 202 biases the deck 202 into either the raised position or the lowered position. Referring to FIG. 7, when the deck 202 is in the lowered position, the deck 202 is supported on the port and starboard pivot brackets 216 via the pivot supports 218, and by the first and second arms 230, 232, which suspend the deck 202 from the pivot brackets 216 via the connection of the second arms 232 to the pivot brackets 216 along the second pivot axis 222. The weight of the deck 202 is transmitted through the first arm 230 to the second arm 232, thereby causing the second arm 232 to rotate about the second pivot axis 222 into abutment with the first stop 244 while the deck 202 is in the lowered position.

As the swim platform assembly 200 is moved into the raised position, the deck 202 and the port and starboard pivot supports 218 pivot about the first pivot axis 220 while the second arms 232 rotate away from the corresponding first stops 244 towards the second stops 246. Once the second arms 232 have been rotated so that the connection between the first arms 230 and the second arms 232 is vertically above the second pivot axis 222, the weight of the deck 202 biases the second arm 232 towards the second stop 246 rather than the first stop 244 as a result of the shape of the first arm 230 and the orientation of the second arms 232 relative to the first arms 230. Thus, once the deck 202 is in the raised position, it is retained in the raised position by its own weight. This may be useful, for example, in order to prevent the deck 202 from incidentally pivoting back into the lowered position.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A swim platform assembly for a boat, the swim platform assembly comprising:

a deck configured to pivot relative to the boat into and between a raised position and a lowered position, wherein in the lowered position the deck is configured to extend transversely relative to a sidewall of the boat and provides a platform surface on which a swimmer can stand; and a suspension linkage configured to suspend the deck from the boat, the suspension linkage including a pivot bracket that defines a pivot axis about which the deck is pivotable into and between the raised position and the lowered position and a suspension arm that couples the deck to the pivot bracket;

wherein the deck is suspended from the pivot bracket via the suspension arm, and wherein the pivot axis is located above the deck and the suspension arm extends through the deck at least when the deck is in the lowered position.

2. The swim platform assembly according to claim 1, further comprising an actuator configured to pivot the deck into and between the raised position and the lowered position.

3. The swim platform assembly according to claim 2, wherein the actuator includes a linear actuator having an inner end configured to be pivotably coupled to the sidewall of the boat and an outer end pivotably coupled to the deck.

4. A swim platform assembly for a boat, the swim platform assembly comprising:

a deck; and a suspension linkage configured to pivotably suspend the deck from a sidewall of the boat, the suspension linkage defining a pivot axis about which the deck is pivotable relative to the boat into and between a raised position and a lowered position in which the deck provides an upper surface on which a swimmer can stand, wherein the pivot axis is above the deck in the lowered position and the suspension linkage extends through the deck at least when the deck is in the lowered position.

5. The swim platform assembly according to claim 4, wherein the suspension linkage extends through a slot extending into an outer edge of the deck when the deck is in the lowered position and wherein the suspension linkage moves out of the slot when the suspension linkage is moved out of the lowered position.

6. The swim platform assembly according to claim 5, wherein the suspension linkage is fixedly coupled to a lower surface of the deck.

7. The swim platform assembly according to claim 4, further comprising an actuator configured to pivot the deck at least into the raised position.

8. The swim platform assembly according to claim 7, wherein the actuator is a linear actuator having an upper end pivotably coupled to the deck and a lower end configured to pivotably couple to the sidewall of the boat.

9. The swim platform assembly according to claim 8, wherein the upper end of the linear actuator is pivotably coupled to a lower surface of the deck.

10. The swim platform assembly according to claim 8, wherein the lower end of the linear actuator is configured to pivotably couple to the sidewall of the boat below the deck.

11. The swim platform assembly according to claim 4, wherein the suspension linkage includes a pivot bracket configured for fixed attachment to the sidewall of the boat and a suspension arm that pivotably suspends the deck from the pivot bracket along the pivot axis.

12. The swim platform assembly according to claim 11, wherein the suspension arm is fixedly coupled to the deck.

13. The swim platform assembly according to claim 11, wherein the suspension arm is fixedly coupled to a lower surface of the deck.

14. The swim platform assembly according to claim 11, further comprising a base bracket configured for fixed attachment to the sidewall of the boat, the base bracket being configured to mate with and support the deck when the deck is pivoted into the lowered position.

15. The swim platform assembly according to claim 4, further comprising a base bracket configured for fixed attachment to the sidewall of the boat, the base bracket being configured to mate with and then support the deck as the deck is pivoted into the lowered position.

16. The swim platform assembly according to claim 15, further comprising a linear actuator configured to pivot the deck at least into the raised position, the linear actuator having an upper end pivotably coupled to the deck and a lower end configured to pivotably couple to the sidewall of the boat below the base bracket, wherein extension of the linear actuator pivots the deck into the raised position and retraction of the linear actuator pivots the deck into the lowered position.

17. A boat comprising the swim platform assembly according to claim 4.

18. A boat comprising:

a deck; and a suspension linkage configured to pivotably suspend the deck from a sidewall of the boat, the suspension linkage defining a pivot axis about which the deck is pivotable relative to the boat into and between a raised position and a lowered position in which the deck provides an upper surface on which a swimmer can stand, wherein the pivot axis is above the deck in the lowered position; and a linear actuator configured to pivot the deck at least into the raised position, the linear actuator having an upper end pivotably coupled to the deck and a lower end pivotably coupled to the sidewall of the boat.

19. The boat according to claim 18, wherein the suspension linkage includes a pivot bracket fixedly coupled to the sidewall of the boat and a suspension arm that pivotably suspends the deck from the pivot bracket along the pivot axis.

20. The boat according to claim 18, further comprising a base bracket fixedly coupled to the sidewall of the boat, the base bracket being configured to mate with and support the deck in the lowered position.

21. The boat according to claim 18, wherein the upper end of the linear actuator is pivotably coupled to the deck and the lower end of the linear actuator is pivotably coupled to the sidewall of the boat below the deck.

22. A swim platform assembly for a boat, the swim platform assembly comprising:

a base bracket configured for fixed attachment relative to the boat;

a deck that is pivotably coupled to the base bracket along a first pivot axis so the deck is pivotable about the first pivot axis into and between a raised position and a lowered position, wherein in the lowered position the deck provides an upper surface for supporting a swimmer; and a pivot linkage configured to support the deck in the raised position and in the lowered position, the pivot linkage including a first arm extending between an upper portion pivotably coupled to the deck and a lower portion, and a second arm extending between an inner portion pivotably coupled to the base bracket and an outer portion pivotably coupled to the lower portion of the first arm, wherein pivoting the deck into the raised position causes the pivot linkage to engage a first stop on the base bracket to support the deck in the raised position and pivoting the deck into the lowered position causes the pivot linkage to engage a second stop on the base bracket to support the deck in the lowered position.

23. The swim platform assembly according to claim 22, configured so a weight of the deck biases the pivot linkage against the first stop as the deck is pivoted towards the raised position and so the weight of the deck biases the pivot linkage against the second stop as the deck is pivoted towards the lowered position.

24. The swim platform assembly according to claim 22, wherein pivoting the deck into the raised position causes the second arm to engage the first stop and the second stop.

25. The swim platform assembly according to claim 22, wherein the first stop and the second stop are provided by cutouts formed in the base bracket.

* * * * *